US006149028A

United States Patent [19]

Yu

[11] Patent Number: 6,149,028

[45] Date of Patent: Nov. 21, 2000

[54] INTEGRATED CUP-HANDLE AND SHAFT STRUCTURE

[76] Inventor: Li-Ya Yu, 18F-2, No. 2, Lane 175, Sec. 3, Shiou-Lang Road, Chung Ho City, Taipei Hsien 235, Taiwan

[21] Appl. No.: 09/350,302

[22] Filed: Jul. 9, 1999

[51] Int. Cl.[7] ..... B65D 25/28

[52] U.S. Cl. ..... 220/741; 220/742

[58] Field of Search ..... 220/741, 742, 220/738, 739

[56] References Cited

U.S. PATENT DOCUMENTS

| | | | |
|---|---|---|---|
| 2,029,051 | 1/1936 | Blevins | 220/741 |
| 2,215,402 | 9/1940 | McDonald | 220/741 |
| 3,107,028 | 10/1963 | De Robertis | 220/742 |
| 3,458,164 | 7/1969 | Massey | 220/741 |
| 4,817,810 | 4/1989 | Shull | 220/741 |
| 4,898,297 | 2/1990 | Wheeler | 220/742 |
| 5,582,321 | 12/1996 | Urbanczyk | 220/742 |
| 5,597,190 | 1/1997 | De Mars | 220/742 |

*Primary Examiner*—Joseph M. Moy
*Attorney, Agent, or Firm*—Dougherty & Troxell

[57] ABSTRACT

This structure is an integrated cup-handle and shaft structure, whose principal components are a cup-stand and handle. The said cup-stand has a circular base. From the said base, extending up, is a semi circular safety-wrap and on its outer wall, at its central point, protrudes a handle. Additionally, from the safety-wrap's central point and from its top, extends a stem. The said stem's top is folded down at an angle, then lips up forming a clip, which all holds the cup when it is placed in the cup-stand. This clip securely holds the cup's mouth so the handle may be grasped and the cup lifted up.

1 Claim, 3 Drawing Sheets

INTEGRATED CUP-HANDLE AND SHAFT STRUCTURE

BACKGROUND OF THE INVENTION (a) Field of the Invention

This invention provides an integrated cup-handle and shaft structure. It is especially designed to securely clasp a cup by which the structure's handle may be grasped.

(b) Description of the Prior Art

Normally a cup is either just a cylinder, or it has a handle affixed to outer the edge. The said latter cup not only allows for handling, it also prevents the user's hand from coming into direct contact with the cup. This in turn prevents scalding to hands due hot drinks in the cup or an aversion to holding the cup due to a cold drink in the cup. When washing the said handled cup, the handle negatively influences the washing process by taking up unnecessary space. Especially in cases of automated washing devices, it creates placement difficulties and is not ideal.

SUMMARY OF THE INVENTION

This invention's principal objective is to offer a cup-handle with securing shaft for secure placement, that is a cup-stand assembled with a handle. The said cup-stand is fitted with a circular base. From the base, extending upwards, is a semi circular safety-wrap and upon the outer surface, at its midpoint is a handle. This allows a cup to be placed in the cup-stand and provides the user a handle to grasp in order to lift the cup up.

The other objective of this invention is the stem of the said cup-stand, which is affixed at the upper center of the safety-wrap. The said stem's top is folded down at an angle, then lipped up forming a clip for setting a cup into the cup-stand. This clip is to hook the mouth of the cup, securing the cup's placement and preventing slippage.

BRIEF DESCRIPTION OF THE DRAWINGS

The invention's principal characteristics and its innovation will be clearer with the presentation of the following practical drawings and the detailed description.

DESCRIPTION OF THE PREFERRED EMBODIMENT

Figure 1:
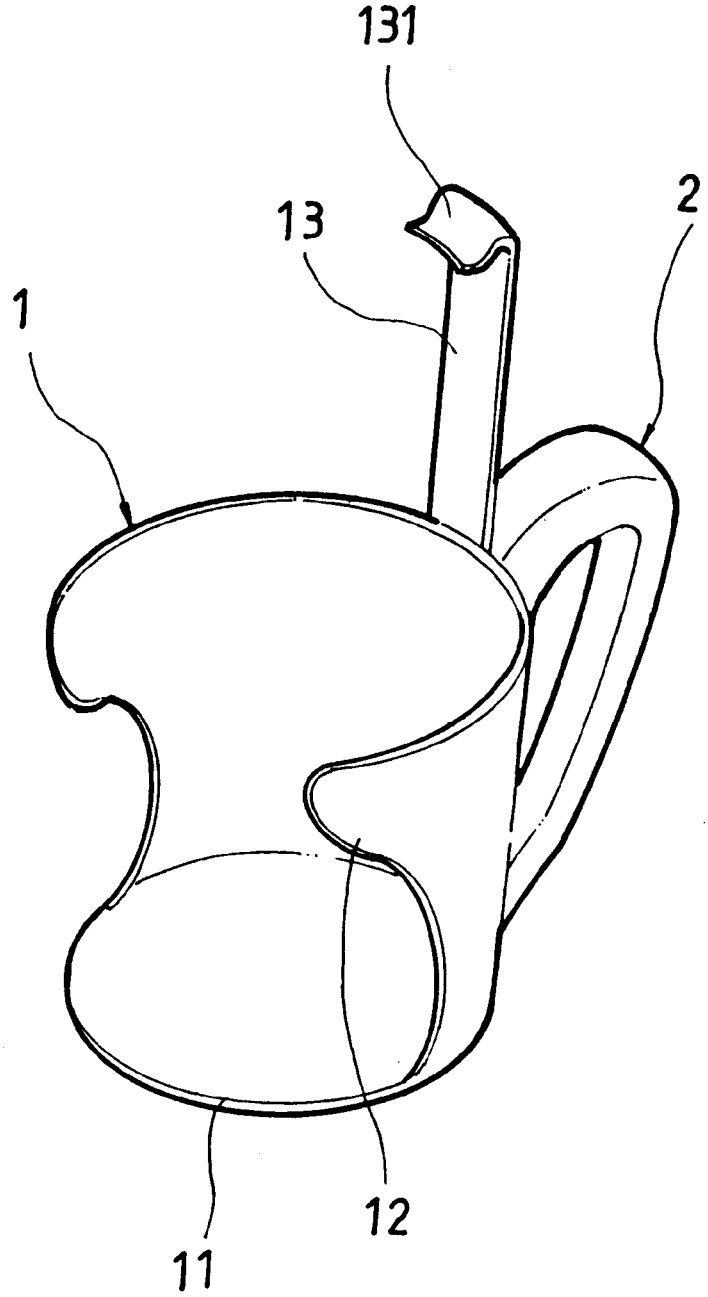
FIG. 1 is a perspective view of the invention.

Please refer to FIG. 1, a pictorial drawing of the invention. The principal component of this invention is cup-stand 1 and handle 2. Said cup-stand 1 has circular base 11 attached. Said base 11 has semi circular safety-wrap 12 extending upward from opposite sides. Of course safety-wrap 12 adjust according to the various needs of curved shapes, flat shapes and cambered shapes. Upon the outer surface and located at the center of the safety-wrap is handle 2, which may be grasped. At safety-wrap 12's central top is proper length stem 13 extending up. The top of said stem 13 is folded down at an angle, then lipped up forming clip 131, which allows a cup to be set once it's placed in cup-stand 1. This is done by stem 13's clip 131 hooking the cup's mouth, thus allowing handle 2 to be grasped and the whole cup picked up for beverage consumption.

Figure 2:
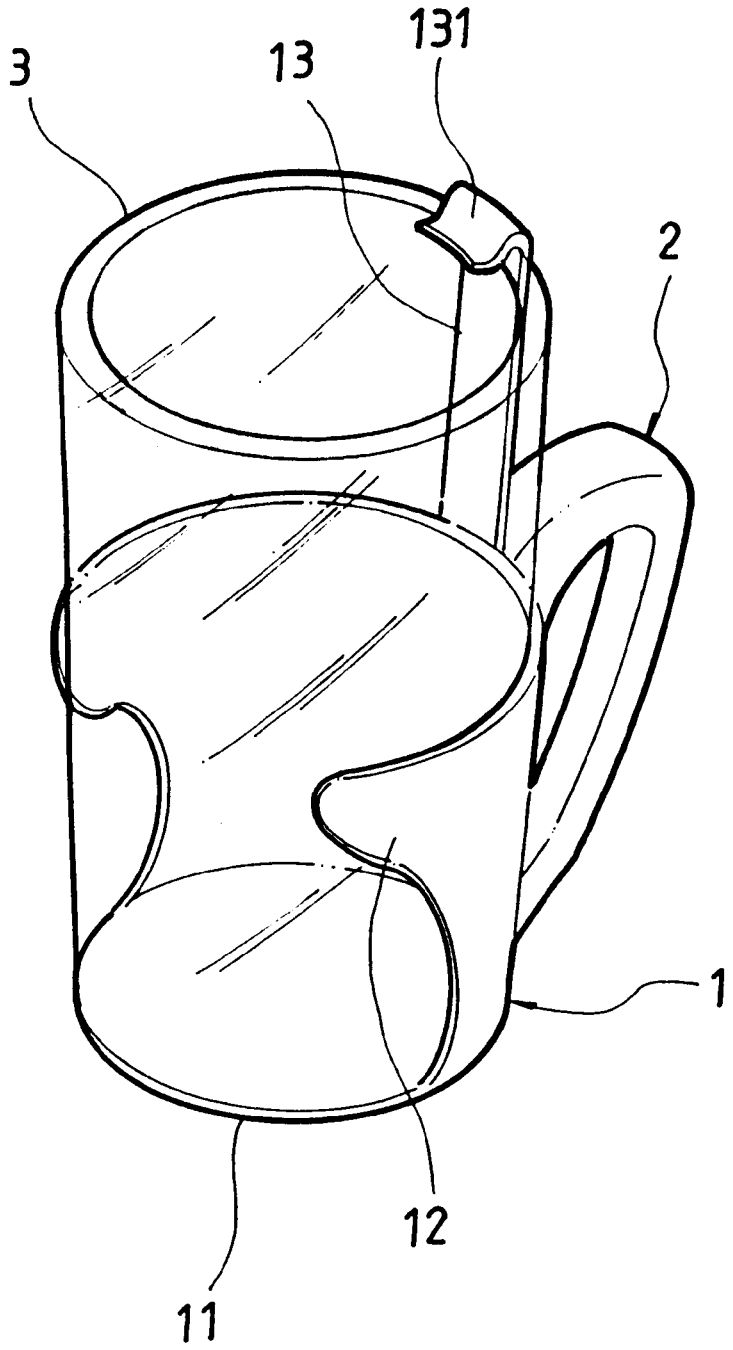
FIG. 2 is a perspective view of a cup placed in the invention.

Please refer to FIG. 2, which is an orthographic drawing of a cup placed in the invention. When the invention is being used, cup 3 is placed into safety-wrap 12 and set on cup-stand 1 allowing safety-wrap 12 to clasp the cup. When cup 3's base is set upon cup-stand 1's base 11, the edge of the cup's mouth slides under stem 13's top clip 131. Due to stem 13's elasticity, clip 131 presses in, catching cup 3's mouth. Cup 3 is then secured firmly in position.

Figure 3:
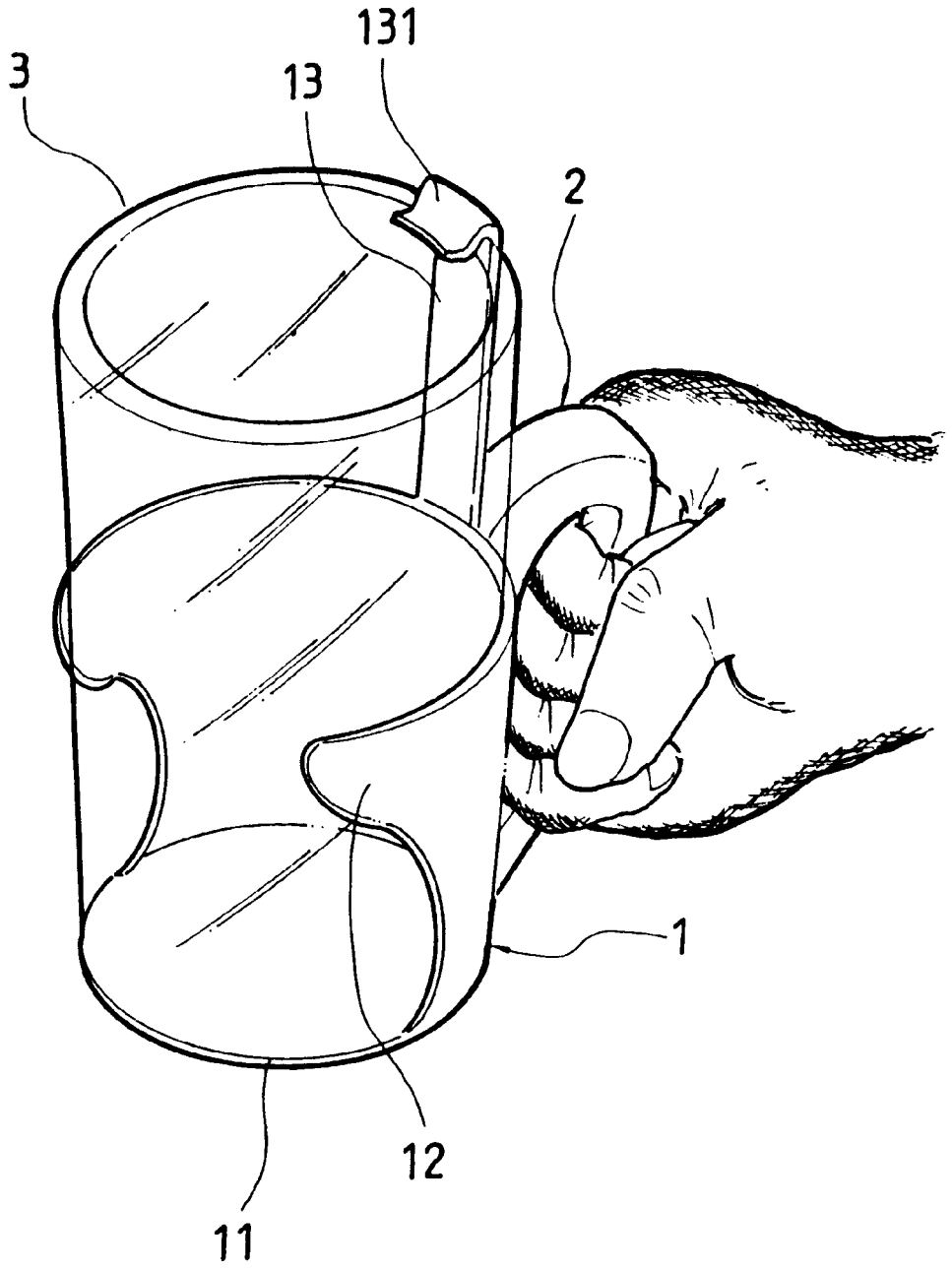
FIG. 3 is a perspective view of the invention.

Please refer to FIG. 3, which is an orthographic drawing of the invention. Once cup 3 is securely placed in cup-stand 1, the user can grasp handle 2 and lift the cup for use without having to directly grasp cup 3 with the hand. This prevents hand injuries due to the high temperature or low temperature beverages. Additionally, when cup 3 needs to be washed, it may be removed from cup-stand 1 and thus won't have a handle to negatively influence the washing process.

In accordance with the above, this invention is a cup-stand with safety-wraps, whereby the design is outfitted with a handle and clip allowing the cup to be set securely. The handle may then be grasped and the cup picked up for the consumption of beverages. For this practical design, a truly original invention, this patent application is submitted in accordance with the laws and regulations.

A type of integrated cup-handle and shaft structure whose main component is a cup-stand for placement and upon the outer wall of the cup-stand is affixed a handle, which allows the user to grasp and thus pick up the cup, whose features are as follows:

1. A cup handle device for holding a drinking cup or glass comprising:

a) a cup stand having a circular base having a planar configuration to support the drinking cup thereon; and an upstanding wall extending from the circular base and configured to removably grip an outer surface of the drinking cup placed on the circular base;

b) a handle extending outwardly from the upstanding wall and configured to be grasped by a hand of a user; and, c) an elastic stem extending from the upstanding wall above the handle, the elastic stem having a distal end with a top clip formed thereon to grip an upper edge of the drinking cup so as to removably attach the cup handle device to the drinking cup.

* * * * *